US006370710B1

(12) United States Patent
Haury et al.

(10) Patent No.: US 6,370,710 B1
(45) Date of Patent: Apr. 16, 2002

(54) BATHTUB PARTITIONING DEVICE

(76) Inventors: William E. Haury; Christy I. Haury, both of 108 Dana Dr., Collinsville, IL (US) 62234

( * ) Notice: Subject to any disclaimer, the term of this patent is extended or adjusted under 35 U.S.C. 154(b) by 0 days.

(21) Appl. No.: 09/810,037

(22) Filed: Mar. 16, 2001

(51) Int. Cl.[7] ..... A47K 3/14; E03C 1/186
(52) U.S. Cl. ..... 4/514; 4/578.1; 4/590
(58) Field of Search ..... 4/514, 578.1, 584, 4/590, 659

(56) References Cited

U.S. PATENT DOCUMENTS

| | | | | | |
|---|---|---|---|---|---|
| 317,333 | A | * | 5/1885 | French | 4/514 |
| 1,817,330 | A | * | 8/1931 | Wilson, Jr. | 4/514 |
| 3,713,179 | A | | 1/1973 | Dubiel | |
| 4,117,558 | A | | 10/1978 | Poth | |
| D275,914 | S | | 10/1984 | Gersin | |
| 5,249,316 | A | | 10/1993 | Macchiavello | |
| 5,423,095 | A | | 6/1995 | Bearer | |
| 5,809,588 | A | | 9/1998 | Angelotti | |
| 6,094,756 | A | * | 8/2000 | Carter | 4/578.1 |

* cited by examiner

*Primary Examiner*—Gregory L. Huson
*Assistant Examiner*—Tuan Nguyen

(57) ABSTRACT

A bathtub partitioning device for limiting the effective usage area of a bathtub. The bathtub partitioning device includes a partition having a top side, a bottom side, a front side, a back side, a first lateral side and a second lateral side. The partition comprises a resiliently compressible material. A biasing member is positionable between the first lateral wall of the partition and an inner surface of one of a pair of lateral walls of a bathtub such that the partition is biased toward the other of the lateral walls of the bathtub. The partition frictionally engages the bathtub when the partition is positioned in the bathtub such that each of the lateral sides of the partition is abutting one of the lateral walls.

10 Claims, 3 Drawing Sheets

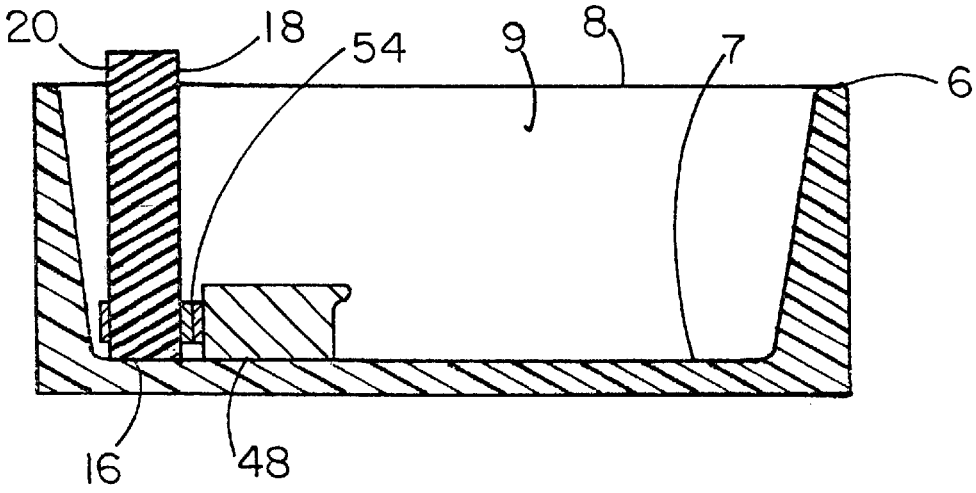
FIG. 3
FIG. 4
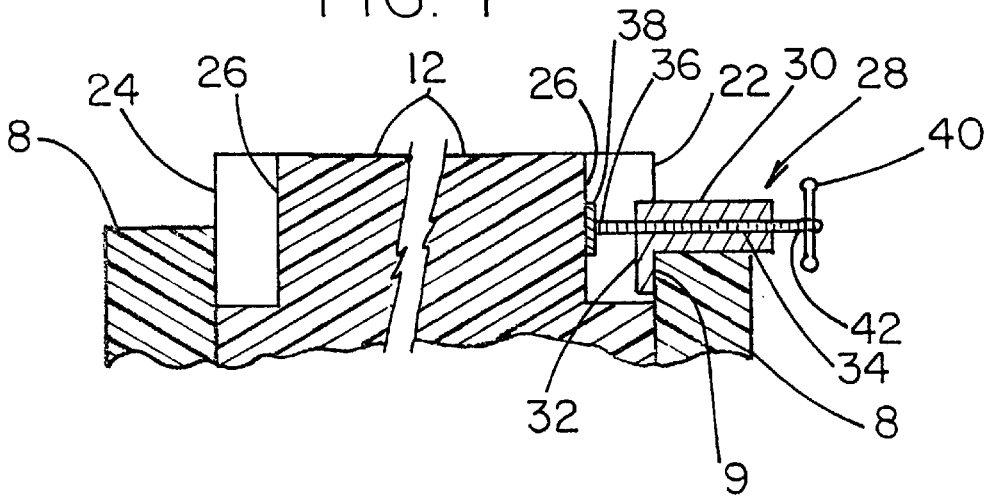

BATHTUB PARTITIONING DEVICE

BACKGROUND OF THE INVENTION

1. Field of the Invention

The present invention relates to bathtub safety devices and more particularly pertains to a new bathtub partitioning device for limiting the effective usage area of a bathtub.

2. Description of the Prior Art

The use of bathtub safety devices is known in the prior art. More specifically, bathtub safety devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,249,316; 5,423,095; 5,809,588; 4,117,558; 3,713,179; U.S. Des. Pat. No. 275,914.

While these devices fulfill their respective, particular objectives and requirements, the aforementioned patents do not disclose a new bathtub partitioning device. The inventive device includes a partition having a top side, a bottom side, a front side, a back side, a first lateral side and a second lateral side. The partition comprises a resiliently compressible material. A biasing member is positionable between the first lateral wall of the partition and an inner surface of one of a pair of lateral walls of a bathtub such that the partition is biased toward the other of the lateral walls of the bathtub. The partition frictionally engages the bathtub when the partition is positioned in the bathtub such that each of the lateral sides of the partition is abutting one of the lateral walls.

In these respects, the bathtub partitioning device according to the present invention substantially departs from the conventional concepts and designs of the prior art, and in so doing provides an apparatus primarily developed for the purpose of limiting the effective usage area of a bathtub.

SUMMARY OF THE INVENTION

In view of the foregoing disadvantages inherent in the known types of bathtub safety devices now present in the prior art, the present invention provides a new bathtub partitioning device construction wherein the same can be utilized for limiting the effective usage area of a bathtub.

The general purpose of the present invention, which will be described subsequently in greater detail, is to provide a new bathtub partitioning device apparatus and method which has many of the advantages of the bathtub safety devices mentioned heretofore and many novel features that result in a new bathtub partitioning device which is not anticipated, rendered obvious, suggested, or even implied by any of the prior art bathtub safety devices, either alone or in any combination thereof.

To attain this, the present invention generally comprises a partition having a top side, a bottom side, a front side, a back side, a first lateral side and a second lateral side. The partition comprises a resiliently compressible material. A biasing member is positionable between the first lateral wall of the partition and an inner surface of one of a pair of lateral walls of a bathtub such that the partition is biased toward the other of the lateral walls of the bathtub. The partition frictionally engages the bathtub when the partition is positioned in the bathtub such that each of the lateral sides of the partition is abutting one of the lateral walls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bathtub partitioning device apparatus and method which has many of the advantages of the bathtub safety devices mentioned heretofore and many novel features that result in a new bathtub partitioning device which is not anticipated, rendered obvious, suggested, or even implied by any of the prior art bathtub safety devices, either alone or in any combination thereof.

It is another object of the present invention to provide a new bathtub partitioning device which may be easily and efficiently manufactured and marketed.

It is a further object of the present invention to provide a new bathtub partitioning device which is of a durable and reliable construction.

An even further object of the present invention is to provide a new bathtub partitioning device which is susceptible of a low cost of manufacture with regard to both materials and labor, and which accordingly is then susceptible of low prices of sale to the consuming public, thereby making such bathtub partitioning device economically available to the buying public.

Still yet another object of the present invention is to provide a new bathtub partitioning device which provides in the apparatuses and methods of the prior art some of the advantages thereof, while simultaneously overcoming some of the disadvantages normally associated therewith.

Still another object of the present invention is to provide a new bathtub partitioning device for limiting the effective usage area of a bathtub.

Yet another object of the present invention is to provide a new bathtub partitioning device which includes a partition having a top side, a bottom side, a front side, a back side, a first lateral side and a second lateral side. The partition comprises a resiliently compressible material. A biasing member is positionable between the first lateral wall of the partition and an inner surface of one of a pair of lateral walls of a bathtub such that the partition is biased toward the other of the lateral walls of the bathtub. The partition frictionally engages the bathtub when the partition is positioned in the bathtub such that each of the lateral sides of the partition is abutting one of the lateral walls.

Still yet another object of the present invention is to provide a new bathtub partitioning device that may be removably retrofitted to existing bathtubs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic cross-sectional view taken along line 3—3 of FIG. 1 of the present invention.

FIG. 4 is a schematic cross-sectional view taken along line 4—4 of FIG. 1 of the present invention.

DESCRIPTION OF THE PREFERRED EMBODIMENT

Figure 1:
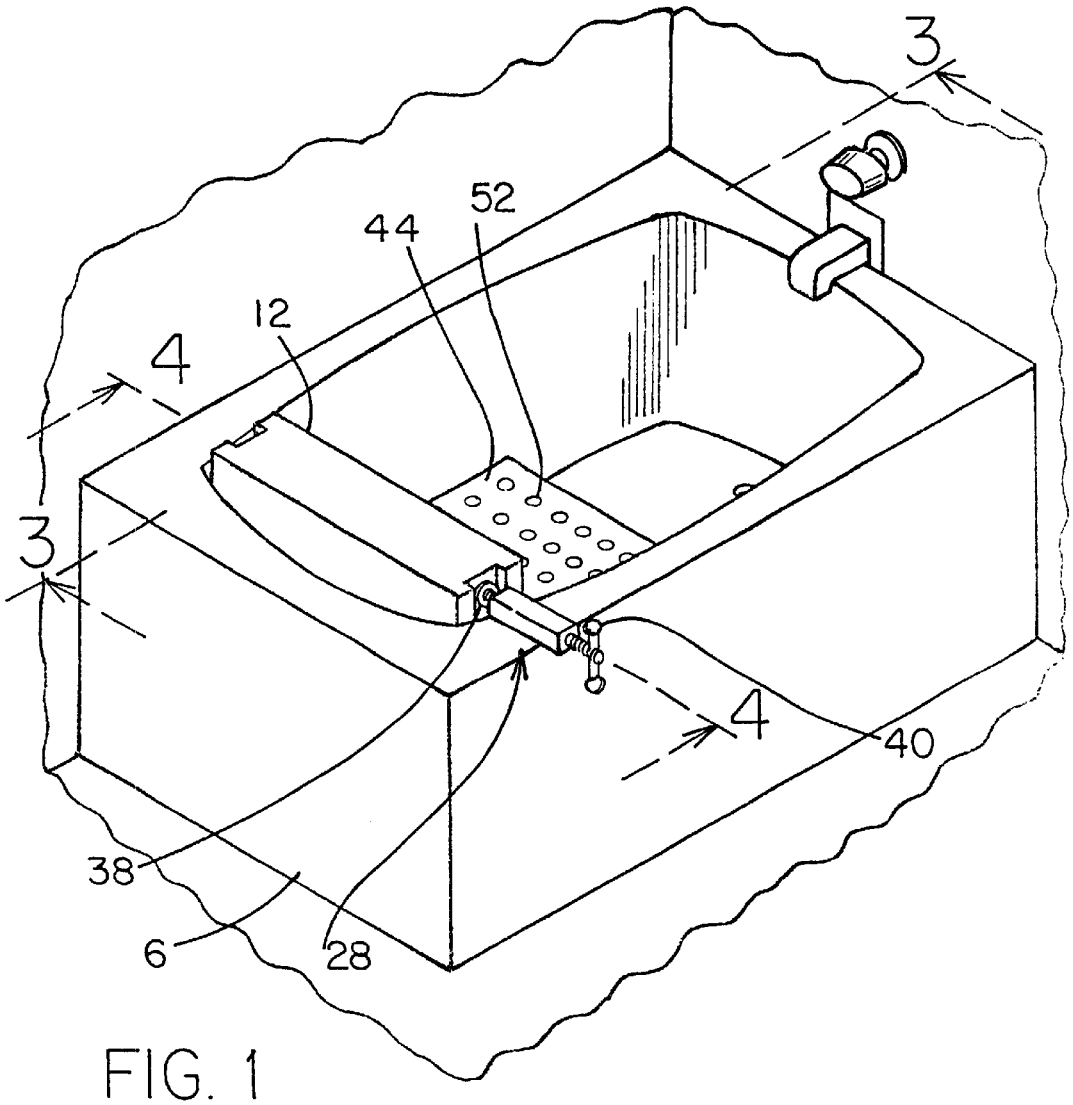
FIG. 1 is a schematic perspective view of a new bathtub partitioning device according to the present invention.
Figure 2:
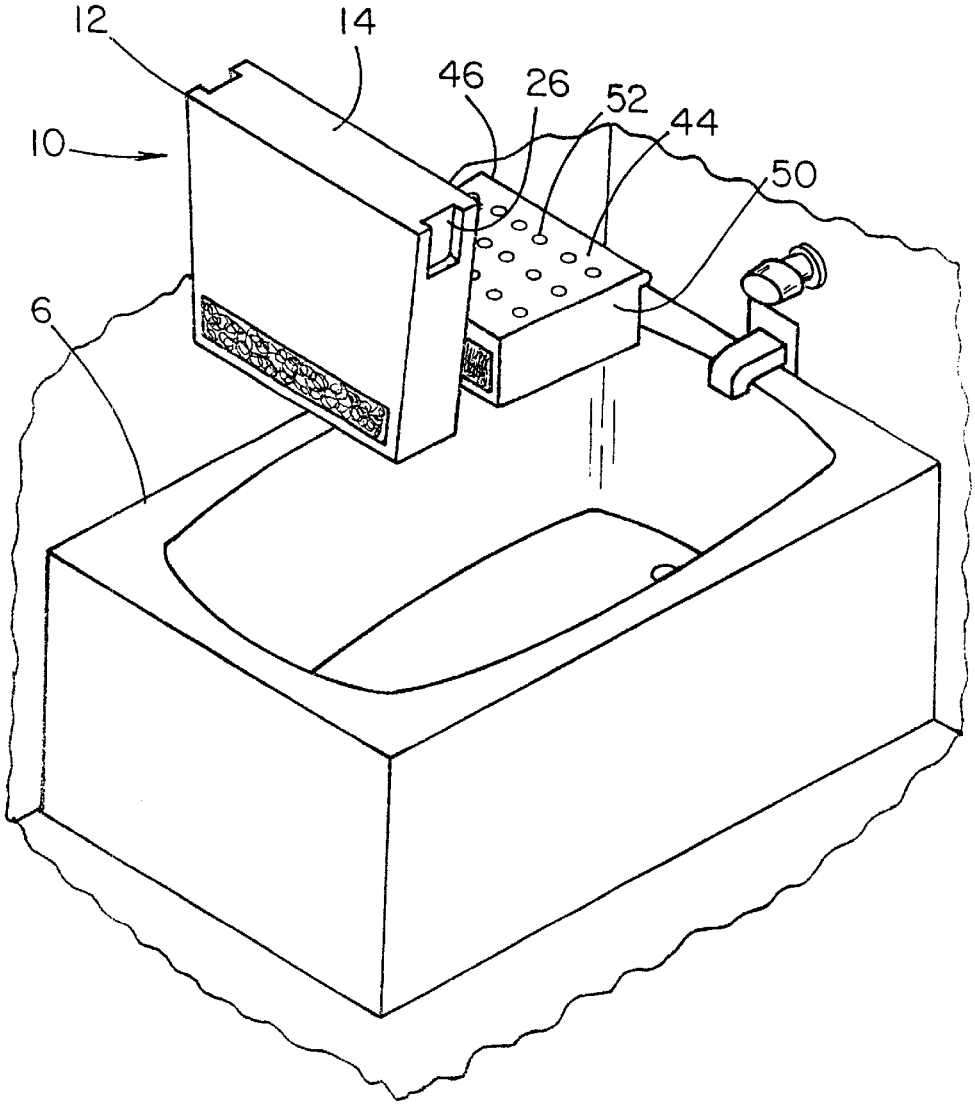
FIG. 2 is a schematic perspective view of the present invention.

With reference now to the drawings, and in particular to FIGS. 1 through 4 thereof, a new bathtub partitioning device embodying the principles and concepts of the present invention and generally designated by the reference numeral 10 will be described.

As best illustrated in FIGS. 1 through 4, the bathtub partitioning device 10 generally comprises a device for removably positioning between a pair of lateral walls 8 of a bathtub 6. The device 10 includes a partition 12 having a top side 14, a bottom side 16, a front side 18, a back side 20, a first lateral side 22 and a second lateral side 24. Each of the lateral sides 22, 24 has one of a pair of slots 26 therein. Each of the slots 26 is positioned adjacent to the top side 14. The partition 12 comprises a resiliently compressible material, such as a foamed elastomeric material. The top side 14 has a length extending between the first 22 and second 24 lateral sides preferably equal to 23 inches. The bottom side 16 has a length extending between the first 22 and second 24 lateral sides preferably equal to 20 inches such that the top side 14 tapers toward the bottom side, 16 though these measurements may vary depending on the size of the bathtub 6. The partition 12 has a width between the front 16 and back 18 sides preferably between 3 and 6 inches. The partition 12 has a height preferably between 13 inches and 15 inches.

A biasing member 28 is positionable between the first lateral wall 22 of the partition 12 and an inner surface 9 of one of the lateral walls 8 of the bathtub 6 such that the partition 12 is biased toward the other of the lateral walls 8 of the bathtub 6. The biasing member 28 has a leg portion 30 coupled to an arm portion 32 such that the biasing member 28 generally has an L-shape. A rod 34 extends through a length of the leg portion 30 and is threadably coupled to the leg portion 30. The rod 34 has a first end 36 having a disc 38 thereon. A handle 40 is attached to the second 42 end of the rod 34. The disc 38 is positioned in the slot 26 in the first lateral side 22 and the arm portion 32 abutted against the inner surface 9 of the lateral wall 8 of the bathtub 6 such that the leg portion 30 is positioned on an upper edge of the lateral side wall 8 of bathtub 6. Rotating the rod 34 in a first direction extends the disc 38 toward the partition 12.

A chair 44 comprises a block having an upper side 46, a lower side 48 and lateral wall 50 extending between the upper 46 and lower 48 sides. The block has a plurality of holes 52 therein extending between and through the upper 46 and lower 48 sides. The holes 52 allow the device to sink better in water. Preferably, the block has a length between 14 and 18 inches, a width between 12 and 16 inches and a height between 6 and 10 inches.

A securing member 54 removably secures the chair 44 to the partition 12. The securing member 54 comprises a hook an loop securing means attached to the front side 18 of the partition generally adjacent to the bottom side 16 and to the peripheral wall 50 of the chair 44.

In use, the partition 12 frictionally engages the bathtub 6 when the partition 12 is positioned in the bathtub 6 such that each of the lateral sides 22, 24 of the partition 12 abuts one of the lateral walls 8 of the bathtub 6. The biasing member 28 adds additional stability to the partition 12. The bottom side 16 of the partition is preferably abutting a bottom wall 5 of the bathtub 6 so that water is restricted from moving around the partition 12. The partition 12 shortens the usable length of the bathtub 7 for safety of a child to prevent drowning and falling.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A bathtub dividing device for removably positioning between a pair of lateral walls of a bathtub, said device comprising:

a partition having a top side, a bottom side, a front side, a back side, a first lateral side and a second lateral side, said partition comprising a resiliently compressible material;

a biasing member being positionable between said first lateral wall of said partition and an inner surface of one of the lateral walls of the bathtub such that said partition is biased toward the other of the lateral walls of the bathtub;

a chair comprising a block having an upper side, a lower side and lateral wall extending between said upper and lower side;

a securing member for removably securing said chair to said partition, and wherein said partition and said biasing member may be positioned in the bathtub such that said partition frictionally engages the bathtub.

2. The bathtub dividing device as in claim 1, wherein said top side of said partition has a length extending between said first and second lateral sides generally equal to 23 inches.

3. The bathtub dividing device as in claim 2, wherein said bottom side of said partition has a length extending between said first and second lateral sides generally equal to 20 inches such that said top side tapers toward said bottom side.

4. The bathtub dividing device as in claim 2, wherein said partition has a width between said front and back sides generally between 3 and 6 inches.

5. The bathtub dividing device as in claim 1, wherein said partition has a height generally between 13 inches and 15 inches.

6. The bathtub dividing device as in claim 1, wherein said biasing, member has a leg portion coupled to an arm portion such that said biasing member generally has an L-shape, a rod extending through a length of said leg portion and being threadably coupled to said leg portion, said rod having a first end having a disc thereon, a handle being attached to said second end of said rod, wherein said disc is positioned against said first lateral slide and said arm portion abutted against said inner surface of the lateral wall of the bathtub such that said leg portion is positioned on an upper edge of the lateral side wall of bathtub, wherein rotating said rod in a first direction extends said disc toward said partition.

7. The bathtub dividing device as in claim 1, wherein said block has a plurality of holes therein extending between and through said upper and lower sides.

8. The bathtub dividing device as in claim 1, wherein said block has a length generally between 14 and 18 inches, a width generally between 12 and 16 inches and a height generally between 6 and 10 inches.

9. The bathtub dividing device as in claim 1, wherein said securing member comprises a hook an loop securing means being attached to said front side of said partition generally adjacent to said bottom side and to said peripheral wall of said chair.

10. A bathtub dividing device for removably positioning between a pair of lateral walls of a bathtub, said device comprising:

a partition having a top side, a bottom side, a front side, a back side, a first lateral side and a second lateral side, each of the lateral sides having one of a pair of slots therein, each of said slots being positioned adjacent to said top side, said partition comprising a resiliently compressible material, said top side having a length extending between said first and second lateral sides generally equal to 23 inches, said bottom side having a length extending between said first and second lateral sides generally equal to 20 inches such that said top side tapers toward said bottom side, said partition having a width between said front and back sides generally between 3 and 6 inches, said partition having a height generally between 13 inches and 15 inches;

a biasing member being positionable between said first lateral wall of said partition and an inner surface of one of the lateral walls of the bathtub such that said partition is biased toward the other of the lateral walls of the bathtub, said biasing member having a leg portion coupled to an arm portion such that said biasing member generally has an L-shape, a rod extending through a length of said leg portion and being threadably coupled to said leg portion, said rod having a first end having a disc thereon, a handle being attached to said second end of said rod, wherein said disc is positioned in said slot in said first lateral side and said arm portion abutted against said inner surface of the lateral wall of the bathtub such that said leg portion is positioned on an upper edge of the lateral side wall of bathtub, wherein rotating said rod in a first direction extends said disc toward said partition;

a chair comprising a block having in upper side, a lower side and lateral wall extending between said upper and lower side, said block having a plurality of holes therein extending between and through said upper and lower sides, said block having a length generally between 14 and 18 inches, a width generally between 12 and 16 inches and a height generally between 6 and 10 inches;

a securing member for removably securing said chair to said partition, said securing member comprising a hook an loop securing means being attached to said front side of said partition generally adjacent to said bottom side and to said peripheral wall of said chair; and wherein said partition and said biasing member may be positioned in the bathtub such that said partition frictionally engages the bathtub.

* * * * *